US007420334B2

(12) United States Patent
Heckmann

(10) Patent No.: US 7,420,334 B2
(45) Date of Patent: Sep. 2, 2008

(54) ELECTRONIC BALLAST FOR A LAMP

(75) Inventor: Markus Heckmann, München (DE)

(73) Assignee: Patent-Treuhand-Gesellschaft für Glühlampen mbH, Munich (DE)

( * ) Notice: Subject to any disclaimer, the term of this patent is extended or adjusted under 35 U.S.C. 154(b) by 337 days.

(21) Appl. No.: 11/402,884

(22) Filed: Apr. 13, 2006

(65) Prior Publication Data

US 2006/0232229 A1 Oct. 19, 2006

(30) Foreign Application Priority Data

Apr. 14, 2005 (DE) ..... 10 2005 017 324

(51) Int. Cl.
*H05B 37/00* (2006.01)

(52) U.S. Cl. ..... 315/224; 315/243; 315/307; 315/DIG. 5

(58) Field of Classification Search ..... 315/224, 315/241 R, 242, 243, 246, 291, 307, DIG. 2, 315/DIG. 5
See application file for complete search history.

(56) References Cited

U.S. PATENT DOCUMENTS 4,560,908 A * 12/1985 Stupp et al. ..... 315/219
4,727,470 A * 2/1988 Nilssen ..... 363/132
5,808,422 A 9/1998 Vankitasubrahmanian et al.

FOREIGN PATENT DOCUMENTS

EP 1 003 357 A1 5/2000
EP 1 404 162 A2 3/2004

OTHER PUBLICATIONS

European Search Report dated Aug. 22, 2006 from corresponding EP Application No. 06007435.8-2206, 6 pages.

* cited by examiner

*Primary Examiner*—David H Vu
(74) *Attorney, Agent, or Firm*—Carlo S. Bessone

(57) ABSTRACT

An electronic ballast for a lamp having a bridge circuit, includes at least one first switch and a second switch coupled between a connection for a supply voltage and a connection for a ground potential, a center point of the bridge circuit between the first switch and second switches; a first and a second connection for a lamp the first connection coupled to the center point; and a signal evaluation unit. The evaluation unit includes a first input coupled to a signal which is at the DC voltage level of the first connection, and second input coupled to a signal which is at the DC voltage level of the second connection, the DC voltage reference potential for the evaluation unit being designed to be variable within a value range which is greater than or equal to the ground potential and is less than or equal to the supply voltage potential.

11 Claims, 3 Drawing Sheets

ELECTRONIC BALLAST FOR A LAMP

FIELD OF THE INVENTION

The present invention relates to an electronic ballast for a lamp, in particular an electronic ballast having a bridge circuit, which comprises at least one first switch and a second switch which are coupled between a connection for a supply voltage and a connection for a ground potential, a center point of the bridge circuit being defined between the first switch and the second switch, a first connection and a second connection for a lamp, the first connection being coupled to the center point of the bridge circuit via an inductance, and a signal evaluation unit, the signal evaluation unit comprising a first input and a second input, the first input being coupled to a signal which is at the DC voltage level of the first connection for the lamp, and the second input being coupled to a signal which is at the DC voltage level of the second connection for the lamp.

BACKGROUND OF THE INVENTION

Such an electronic ballast for a lamp is known. In this case, the difference between the DC voltage level of the first connection for the lamp and of the second connection for the lamp is determined and evaluated in a signal evaluation unit which is connected to the ground potential as the reference potential in order to provide information on the remaining life of the lamp. In particular, when it is established that the lamp is approaching its end of life (EoL), driving of the bridge circuit is disconnected in order to prevent damage in the electronic ballast. A DC voltage at the level of the DC voltage potential of the center point of the bridge circuit is superimposed on the actual DC voltage useful signal. Since the voltage dividers and comparator circuits required for evaluation purposes are subject to the conventional tolerances, this means that typically +/−4% of the potential at the center point of the bridge circuit is produced as the error in the measured value by a voltage divider when using resistors with a 1% tolerance. The supply voltage is, for example, 450 V; the potential at the center point of the bridge circuit is therefore approximately 225 V. With an error of +/−4%, the error in the measured value is thus approximately +/−9 V. Since the DC voltage useful signal for identifying an "EoL situation" is generally of the order of magnitude of from 10 to 20 V, reliable EoL detection is therefore not possible.

SUMMARY OF THE INVENTION

The object of the present invention consists in developing the electronic ballast mentioned initially such that more reliable EoL detection is thus made possible.

The present invention is based on the knowledge that evaluation of the DC voltage useful signal which is subject to fewer faults can be achieved during EoL detection if, during the evaluation, the DC voltage reference potential for the signal evaluation unit does not represent the ground potential but represents a potential which is designed to be variable within a value range whose boundaries are defined by the ground potential and the supply voltage potential. Accordingly, the smaller the DC voltage component which is superimposed on the DC voltage useful signal, the smaller the error in the measurement result.

One particularly advantageous embodiment is therefore characterized by the fact that the DC voltage reference potential for the signal evaluation unit is essentially the potential of the center point of the half-bridge circuit. In the case of a "floating" EoL detection dimensioned in this manner, the DC voltage useful signal is accordingly not superimposed by any interfering DC voltage. The measurement error owing to component tolerances is therefore minimal, and the reliability of the result is maximal.

One preferred embodiment also comprises a control unit for the purpose of driving the first switch and the second switch, the control unit having a disconnection or regulation input, which is coupled to the signal evaluation unit, the control unit and the signal evaluation unit being designed to interact such that, in the event of a difference between the DC voltage component of the signals at the two inputs of the signal evaluation unit which is above a predeterminable limit value, the signal evaluation unit drives the control unit via the disconnection or regulation input such that no driving of the first switch and/or the second switch is carried out or the first switch and/or the second switch are driven such that the output power of the electronic ballast is reduced. Owing to this measure, damage to the electronic ballast is reliably prevented when an EoL situation is detected. When continuing to operate a lamp in an EoL situation, there is also the risk of the lamp overheating, which may result in breakage or melting of the lamp and thus in people in the environment of the lamp being endangered.

In one further preferred embodiment, the control unit has a supply voltage connection and is connected to the ground potential as a DC voltage reference potential. The signal evaluation unit comprises a latch and is designed to activate the latch if the difference in the DC voltage component of the signals at the two inputs of the signal evaluation unit is above a predeterminable limit value, the output of the latch being coupled to the supply voltage connection of the control unit and/or the signal evaluation unit via the series circuit comprising a diode and a nonreactive resistor. In this variant, the signal evaluation unit is in the form of an active circuit, the supply voltage of the control unit and/or the signal evaluation unit, which is generally of the order of magnitude of 15 V and thus of the order of magnitude of EoL DC voltage useful signal, being used for evaluation purposes in a skillful manner. If the output signal of the signal evaluation unit is combined in this manner with the supply voltage of the control unit and/or the signal evaluation unit, the signal which can be tapped off at the connection point between the diode and the nonreactive resistor, the so-called EoL signal, is characterized by the fact that, in the case of an intact lamp, it is a signal having a constant amplitude, whereas this signal is a square-wave signal in the case of a defective lamp. The difference between the DC voltage signal and the square-wave signal can be evaluated in a very simple manner. As a result, it is possible to implement extremely cost-effective and reliable EoL detection.

In the case of an implementation of the signal evaluation unit using passive components, the signal evaluation unit has a capacitor which is arranged such that it has a voltage drop across it which corresponds to the difference in the DC voltage component of the signals at the two inputs of the signal evaluation unit, the capacitor being coupled to the supply voltage connection of the control unit via the series circuit comprising a diode and a nonreactive resistor. If, in turn, the so-called EoL signal at the connection point between the diode and the nonreactive resistor is taken into consideration here, it is now possible for an intact lamp to be established by means of a positive square-wave signal. A defective lamp is characterized by a signal having a constant amplitude, in the case of a positive DC voltage useful signal, while an EoL signal having a square-wave shape is produced in the case of a negative DC voltage useful signal, but this also has negative amplitude components, in contrast to the square-wave signal in the case of an intact lamp. These three signals can also be differentiated from one another in a very simple manner and make possible cost-effective and reliable EoL detection of a lamp.

The connection point between the diode and the nonreactive resistor is therefore preferably coupled to a disconnection or regulation input of the control unit.

In order to carry out a comparison of the voltage components of the signals at their two inputs, the signal evaluation unit may comprise a comparator unit.

Further preferred embodiments are described in the dependent claims.

BRIEF DESCRIPTION OF THE DRAWINGS

One exemplary embodiment of the invention will now be described in more detail below with reference to the attached drawings, in which.

DETAILED DESCRIPTION OF THE INVENTION

Figure 1:
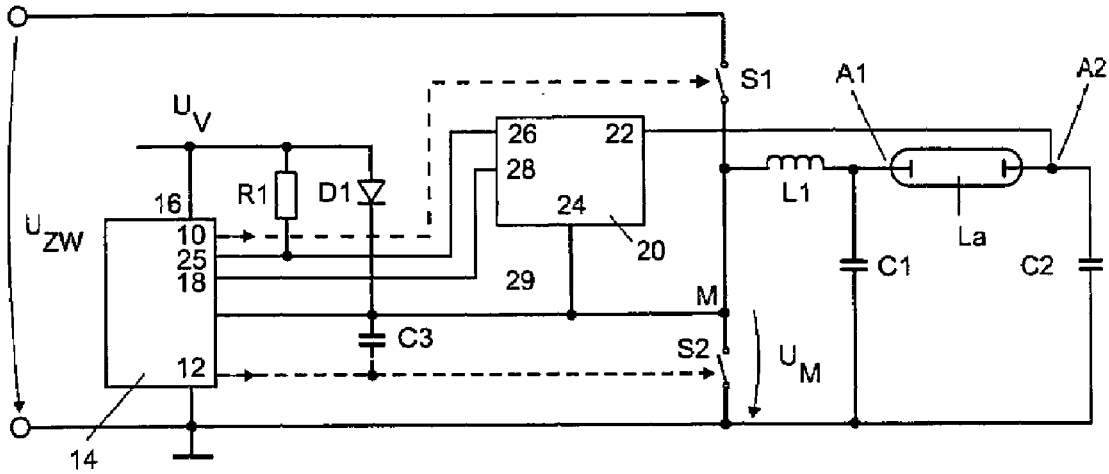
FIG. 1 shows a schematic illustration of a section of an electronic ballast according to the invention.

FIG. 1 shows a schematic illustration of an electronic ballast according to the invention for a lamp. Since such electronic ballasts are generally known, only the part relevant to the invention is illustrated schematically for reasons of clarity. In this case, a first switch S1 and a second switch S2, which between them define a center point M, have the so-called intermediate circuit voltage $U_{ZW}$ applied to them. The center point M is coupled to a first connection A1 of a lamp La via an inductance L1. Moreover, the connection A1 is connected to the ground potential via a coupling capacitor C1. The second connection A2 for the lamp La is coupled to the ground potential via a coupling capacitor C2. An inductance L1 is coupled between the center point M of the half-bridge circuit and the first connection A1 for a lamp. The electronic ballast comprises a control unit 14, which drives the switch S1 via an output 10 and the switch S2 via an output 12 in a known manner in opposition using a high-frequency square-wave signal. The supply voltage $U_V$ of the control unit 14 is present at the input 16 of the control unit 14. $U_V$ is 15 V. The supply voltage $U_V$ is produced from the voltage $U_M$ at the center point of the bridge circuit by means of a bootstrap circuit which comprises a capacitor C3 and a diode D1. The potential at the capacitor C3 is applied to an input 18 of the control unit 14 and is used for supplying a driver circuit (not illustrated), which is arranged in the control unit 14, for the signal at the output 10 of the control unit 14. The electronic ballast according to the invention also comprises a signal evaluation unit 20, which is fed a signal at its input 22 which is at the DC voltage level of the connection A2 for the lamp La. At the input 24, the signal evaluation unit 20 is fed a signal which is at the DC voltage level of the connection A1 for the lamp La. At its output 26, the control unit 20 makes available a so-called EoL signal which is coupled to the input 25 of the control unit 14. The input 25 of the control unit 14 is moreover connected to the supply voltage $U_V$ for the control unit 14 via a resistor R1. The signal evaluation unit 20 is coupled to the capacitor C3 via an optional line 29. The signal evaluation unit 20 is fed the potential across C3 as the supply voltage and not the voltage $U_V$, which is used for supplying the control unit 14, since the voltage $U_V$ is a voltage which is fixedly associated with the ground potential and the signal evaluation unit 20, corresponding to its resonating reference potential, also requires a resonating supply voltage. The line 29 is required in the case of a design of the signal evaluation unit 20 with active components, while it is dispensed with in the case of an implementation of the signal evaluation unit 20 with passive components. The potential at the center point M of the bridge circuit, which is coupled to the signal evaluation unit 20 via the input 24, acts as the DC voltage reference potential for the signal evaluation unit 20.

Figure 2:
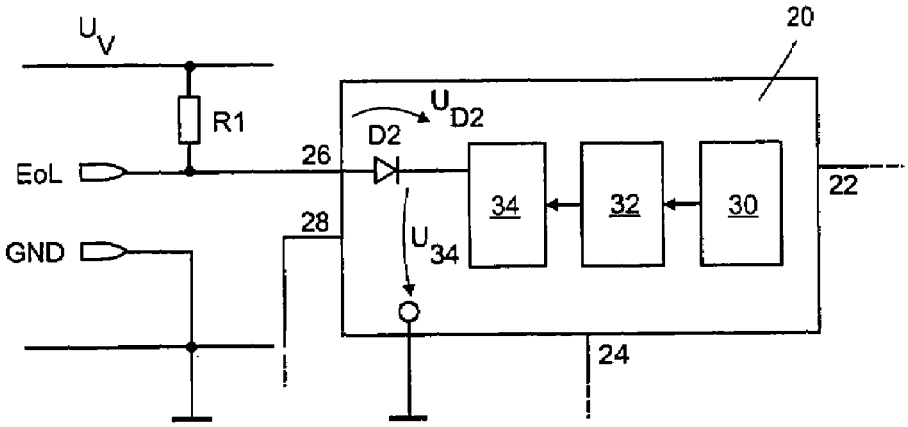
FIG. 2 shows a detailed section from FIG. 1 with an implementation of the signal evaluation unit with active components.
Figure 3A:
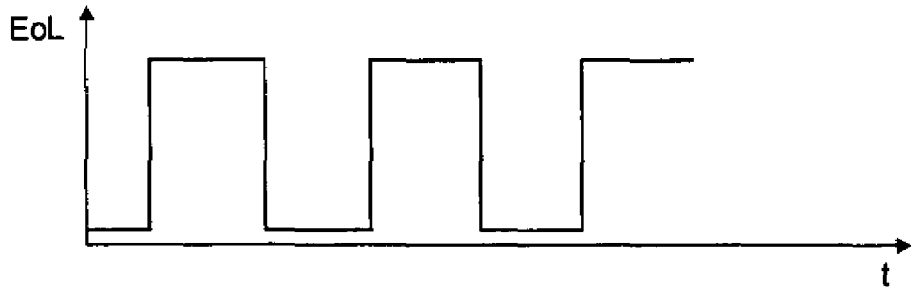
FIG. 3*a* shows the temporal profile of the EoL signal with an implementation of the signal evaluation unit shown in FIG. 2 and a defective lamp.

FIG. 2 shows a detailed view of a section from FIG. 1, the signal evaluation unit 20 being in the form of an active circuit. It comprises a signal processing unit 30, which determines the DC voltage difference between the two signals fed to the inputs 22 and 24. It also comprises a delay unit 32, which is fed the output signal of the signal processing unit 30, the delay unit 32 being used for preventing premature disconnection as a result of the disconnection condition being met for only a short period of time. In particular, disconnection states which last for a shorter period of time than approximately 0.5 s are thus filtered out. The output signal of the delay unit 32 is fed to a memory unit 34, in particular a latch memory. A diode D2 is arranged between the output of the memory unit 34 and the output 26 of the signal evaluation unit 20. After a lamp fault, the latch memory responds such that the voltage made available at the output of the memory unit 34 corresponds to the voltage $U_M$. $U_M$ changes back and forth, as a square-wave signal, between the ground potential i.e. 0 V, and the intermediate circuit voltage $U_{ZW}$. The memory unit 34 is designed such that it makes a "low" signal available at its output in the activated state. As a result of the fact that the reference potential of the signal evaluation unit 20 is the voltage $U_M$, accordingly, in the case of an activated memory unit, i.e. when an EoL situation has been established, the voltage $U_M$ is present as the voltage $U_{34}$ at the output of the memory unit 34. At times at which the voltage $U_{34}$ is related to the ground potential 0 V, the diode is on and the EoL signal becomes 0 V when disregarding the diode voltage $U_{D2}$. If $U_{34}$ is equal to $U_{ZW}$, the diode D2 is off and the EoL signal becomes $U_V$ equal to 15 V. In this context, reference is made to the illustration in FIG. 3*a*.

Figure 3B:
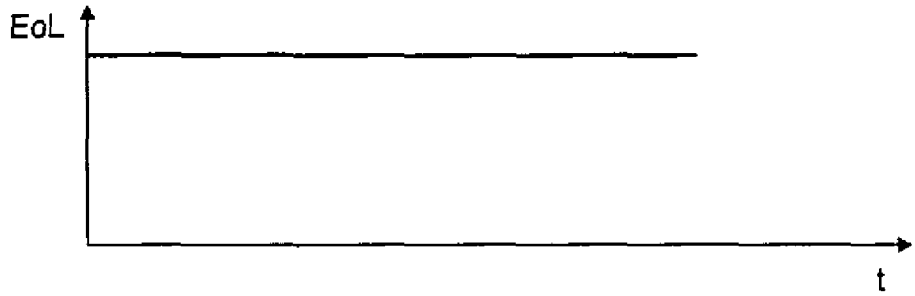
FIG. 3*b* shows the temporal profile of the EoL signal with an implementation of the signal evaluation unit shown in FIG. 2 and an intact lamp.

In the case of an intact lamp, the memory unit 34 makes a "high," signal available at its output, i.e. $U_{34}$ is accordingly $U_M+U_V$. Independently of the changes made by $U_M$ between 0 and $U_{ZW}$, the potential at the cathode of the diode D2 is therefore always equal to $U_V$, with the result that the diode D2 is always off. The EoL signal is therefore constantly equal to $U_V$, cf. the illustration in FIG. 3*b*.

Figure 4:
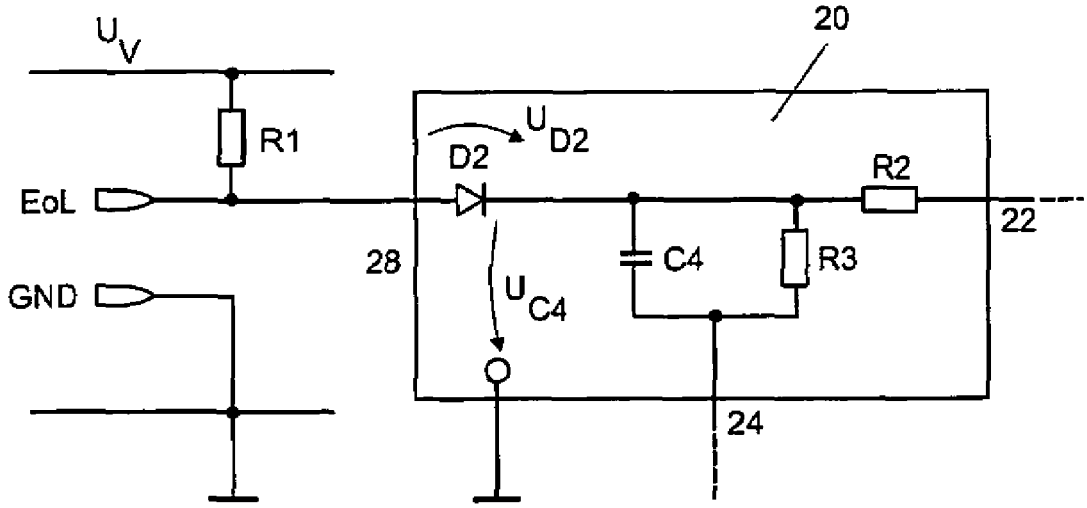
FIG. 4 shows a detailed section from FIG. 1 with an implementation of the signal evaluation unit with passive components.

FIG. 4 shows the section corresponding to FIG. 2 from FIG. 1 with an implementation of the signal evaluation unit 20 by means of passive components. In this case, the signal at the input 24 of the signal evaluation unit 20 is fed to the parallel circuit comprising a capacitor C4 and a nonreactive resistor R3, while the signal at the input 22 of the signal evaluation unit 20 is coupled to the series circuit comprising the capacitor C4 and the nonreactive resistor R3 via a nonreactive resistor R2. The diode D2 is provided as in the embodiment in FIG. 2. With reference to FIG. 5, various states can occur as a function of the DC voltage difference between the signals at the inputs 22 and 24: in this case, $U_{C4}$ is the voltage between the connection, which is connected to the diode D2, of the capacitor C4 and the ground potential.

Figure 5A:
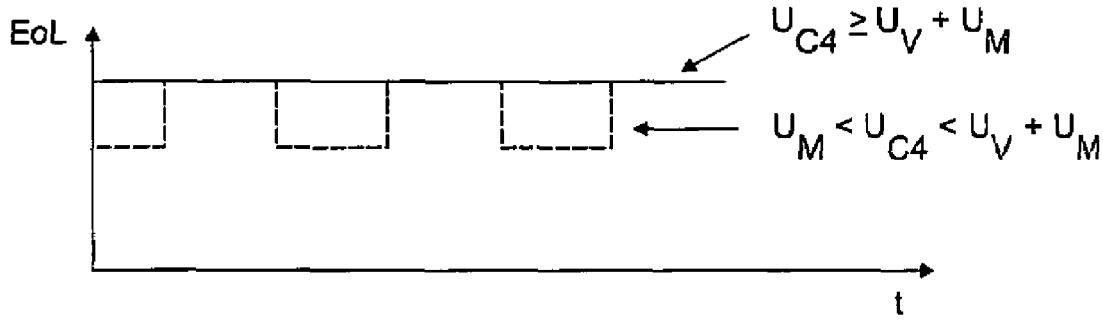
FIG. 5*a* shows the temporal profile of the EoL signal with an implementation of the signal evaluation unit shown in FIG. 4 in the case of a positive DC voltage useful signal.

FIG. 5*a:* this figure shows the temporal profile of the EoL signal, i.e. the voltage at the input 25 of the control unit 14, in the case of a positive DC voltage useful signal. As long as the voltage $U_{C4}$ is greater than or equal to $U_V+U_M$, the diode D2 is off and the EoL signal corresponds to the voltage $U_V$, which is brought about via the highly resistive resistor R1. If the voltage $U_{C4}$ is greater than $U_M$ and is less than $U_V+U_M$, the diode D2 is off at times at which $U_M$ is equal to $U_{ZW}$. At times at which $U_M$ is equal to 0, the diode D2 is on and transfers the voltage $U_{C4}$ to the EoL input of the control unit 14. The voltage $U_V$ is suppressed as a result of the highly resistive resistor R1 and is not involved.

Figure 5B:
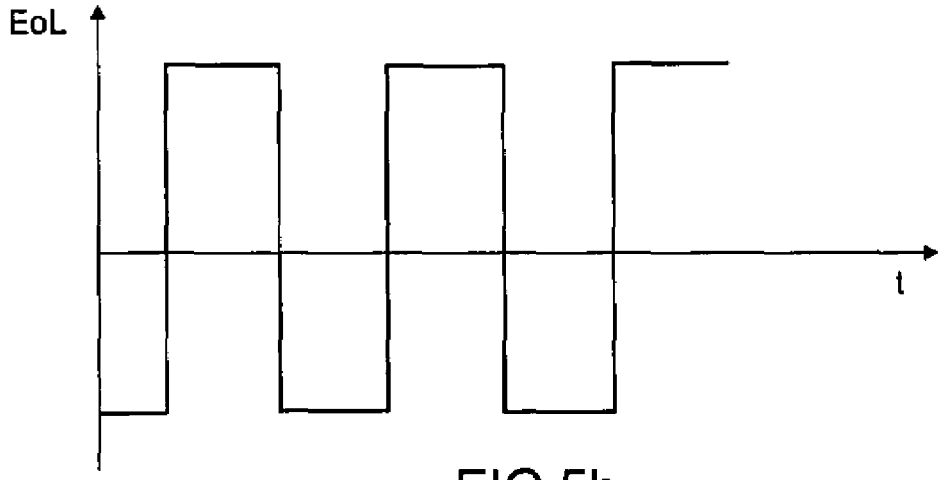
FIG. 5*b* shows the temporal profile of the EoL signal with an implementation of the signal evaluation unit shown in FIG. 4 in the case of a negative DC voltage useful signal.

FIG. 5*b:* This figure shows the temporal profile of the EoL signal in the case of a negative DC voltage useful signal. The capacitor C4 is accordingly negatively charged. At times at which $U_M$ is equal to $U_{ZW}$, this negative charge does not have any effect as a result of the high voltage $U_{ZW}$, the diode D2 is off and the EoL signal is equal to $U_V$. At times at which $U_M$ is equal to 0, the diode D2 is on and the negative voltage, to which C4 is charged, dominates the EoL signal since R1 is highly resistive.

Figure 5C:
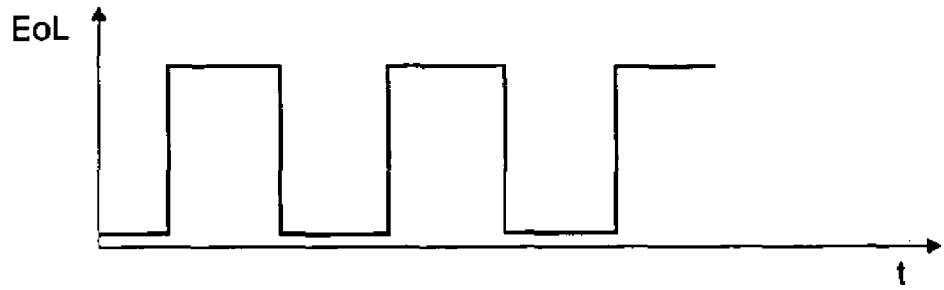
FIG. 5*c* shows the temporal profile of the EoL signal with an implementation of the signal evaluation unit shown in FIG. 4 with an intact lamp.

FIG. 5*c:* This figure shows the temporal profile of the EoL signal in the case of an intact lamp. $U_{C4}$ is accordingly equal to $U_M$, with the result that the diode is on when $U_M$ is equal to 0 V and the EoL signal is likewise 0 V. If $U_M$ is equal to $U_{ZW}$, the diode D2 is off and the EoL signal is equal to $U_V$.

Corresponding evaluation of the EoL signal is implemented in the control unit 14. The switches S1 and S2 are driven in a corresponding manner via the outputs 10 and 12 of the control unit 14 on the basis of the result of the evaluation.

The invention claimed is:

1. An electronic ballast for a lamp having a bridge circuit, which comprises at least one first switch (S1) and a second switch (S2) which are coupled between a connection (A1) for a supply voltage and a connection (A2) for a ground potential, a center point (M) of the bridge circuit being defined between the first switch (S1) and the second switch (S2);

a first connection (A1) and a second connection (A2) for a lamp (La), the first connection (A1) being coupled to the center point (M) of the bridge circuit via an inductance (L1); and a signal evaluation unit (20), the signal evaluation unit (20) comprising a first input (24) and a second input (22), the first input (24) being coupled to a signal which is at the DC voltage level of the first connection (A1) for the lamp (La), and the second input (22) being coupled to a signal which is at the DC voltage level of the second connection (A2) for the lamp (La), characterized in that the DC voltage reference potential for the signal evaluation unit (20) is designed to be variable within a value range which is greater than or equal to the ground potential and is less than or equal to the supply voltage potential.

2. The electronic ballast as claimed in claim 1, characterized in that the DC voltage reference potential for the signal evaluation unit (20) is essentially the potential ($U_M$) of the center point (M) of the bridge circuit.

3. The electronic ballast as claimed in claim 1, characterized in that it also comprises a control unit (14) for the purpose of driving the first switch (S1) and the second switch (S2), the control unit (14) having a disconnection or regulation input, which is coupled to the signal evaluation unit (20), the control unit (14) and the signal evaluation unit (20) being designed to interact such that, in the event of a difference between the DC voltage component of the signals at the two inputs (22, 24) of the signal evaluation unit which is above a predeterminable limit value, the signal evaluation unit (20) drives the control unit (14) via the disconnection or regulation input such that no driving of the first switch (S1) and/or the second switch (S2) is carried out or the first switch (S1) and/or the second switch (S2) are driven such that the output power of the electronic ballast is reduced.

4. The electronic ballast as claimed in claim 3, characterized in that the control unit (14) has a supply voltage connection and is connected to the ground potential as a DC voltage reference potential, the signal evaluation unit (20) comprises a latch and is designed to activate the latch if the difference in the DC voltage component of the signals at the two inputs (22, 24) of the signal evaluation unit (20) is above a predeterminable limit value, the output (26) of the latch being coupled to the supply voltage connection (16) of the control unit (14) and/or the signal evaluation unit (20) via the series circuit comprising a diode (D2) and a nonreactive resistor (R1).

5. The electronic ballast as claimed in claim 3, characterized in that the control unit (14) has a supply voltage connection and is connected to the ground potential as the reference potential, the signal evaluation unit (20) has a capacitor (C4) which is arranged such that it has a voltage drop across it which corresponds to the difference in the DC voltage component of the signals at the two inputs (22, 24) of the signal evaluation unit (20), the capacitor (C4) being coupled to the supply voltage connection (16) of the control unit (14) via the series circuit comprising a diode (D2) and a nonreactive resistor (R1).

6. The electronic ballast as claimed in claim 4, characterized in that the connection point between the diode (D2) and the nonreactive resistor (R1) is coupled to a disconnection or regulation input of the control unit (14).

7. The electronic ballast as claimed in claim 5, characterized in that the connection point between the diode (D2) and the nonreactive resistor (R1) is coupled to a disconnection or regulation input of the control unit (14).

8. The electronic ballast as claimed in claim 1, characterized in that the signal evaluation unit (20) comprises a comparator unit.

9. The electronic ballast as claimed in claim 2, characterized in that it also comprises a control unit (14) for the purpose of driving the first switch (S1) and the second switch (S2), the control unit (14) having a disconnection or regulation input, which is coupled to the signal evaluation unit (20), the control unit (14) and the signal evaluation unit (20) being designed to interact such that, in the event of a difference between the DC voltage component of the signals at the two inputs (22, 24) of the signal evaluation unit which is above a predeterminable limit value, the signal evaluation unit (20) drives the control unit (14) via the disconnection or regulation input such that no driving of the first switch (S1) and/or the second switch (S2) is carried out or the first switch (S1) and/or the second switch (S2) are driven such that the output power of the electronic ballast is reduced.

10. The electronic ballast as claimed in claim 9, characterized in that the control unit (14) has a supply voltage connection and is connected to the ground potential as a DC voltage reference potential, the signal evaluation unit (20) comprises a latch and is designed to activate the latch if the difference in the DC voltage component of the signals at the two inputs (22, 24) of the signal evaluation unit (20) is above a predeterminable limit value, the output (26) of the latch being coupled to the supply voltage connection (16) of the control unit (14) and/or the signal evaluation unit (20) via the series circuit comprising a diode (D2) and a nonreactive resistor (R1).

11. The electronic ballast as claimed in claim 9, characterized in that the control unit (14) has a supply voltage connection and is connected to the ground potential as the reference potential, the signal evaluation unit (20) has a capacitor (C4) which is arranged such that it has a voltage drop across it which corresponds to the difference in the DC voltage component of the signals at the two inputs (22, 24) of the signal evaluation unit (20), the capacitor (C4) being coupled to the supply voltage connection (16) of the control unit (14) via the series circuit comprising a diode (D2) and a nonreactive resistor (R1).

* * * * *